US009555986B2

(12) United States Patent
Kawamata et al.

(10) Patent No.: US 9,555,986 B2
(45) Date of Patent: Jan. 31, 2017

(54) IMAGE RECORDING APPARATUS

(71) Applicant: BROTHER KOGYO KABUSHIKI KAISHA, Nagoya-shi, Aichi-ken (JP)

(72) Inventors: Noriyuki Kawamata, Nagoya (JP); Yasuhira Ota, Yatomi (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/668,699

(22) Filed: Mar. 25, 2015

(65) Prior Publication Data

US 2015/0274463 A1 Oct. 1, 2015

(30) Foreign Application Priority Data

Mar. 31, 2014 (JP) ..... 2014-073835

(51) Int. Cl.
*B65H 3/06* (2006.01)
*B65H 5/06* (2006.01)
*B65H 5/38* (2006.01)

(52) U.S. Cl.
CPC ..... *B65H 3/0684* (2013.01); *B65H 5/062* (2013.01); *B65H 5/38* (2013.01); *B65H 2402/441* (2013.01); *B65H 2402/46* (2013.01); *B65H 2403/53* (2013.01); *B65H 2404/1442* (2013.01); *B65H 2404/6111* (2013.01); *B65H 2405/3322* (2013.01); *B65H 2407/20* (2013.01); *B65H 2601/11* (2013.01)

(58) Field of Classification Search
CPC ..... B65H 3/0684; B65H 5/062; B65H 5/38; B65H 2402/441; B65H 2407/20; B65H 2601/11; B65H 2405/3322; B65H 2404/1442; B65H 2402/46; B65H 2403/53; B65H 2404/6111
USPC ..... 271/272–274
See application file for complete search history.

(56) References Cited

U.S. PATENT DOCUMENTS

2004/0175210 A1* 9/2004 Otaka ..... B65H 5/062 399/318
2014/0147183 A1* 5/2014 Koshida ..... G03G 15/657 399/388

FOREIGN PATENT DOCUMENTS

JP 2013-184754 A 9/2013

* cited by examiner

*Primary Examiner* — David H Bollinger
(74) *Attorney, Agent, or Firm* — Merchant & Gould P.C.

(57) ABSTRACT

An image recording apparatus includes: a housing including a frame and a conveyance path; a recording device which records an image on a sheet conveyed along the conveyance path; a first roller located upstream of the recording device; a second roller opposed to the first roller; a guide member pivotable between a first position for partly defining the conveyance path and a second position where the conveyance path is open; a roller holder coupled to the guide member and supporting the second roller; an urging portion which urges the second roller toward the first roller; and an engaging portion supported by the roller holder and configured to, when the guide member is located at the first position, be engaged with the frame to position the roller holder to a third position where the second roller contacts the first roller by an urging force of the urging portion.

15 Claims, 7 Drawing Sheets

IMAGE RECORDING APPARATUS

CROSS REFERENCE TO RELATED APPLICATION

The present application claims priority from Japanese Patent Application No. 2014-073835, which was filed on Mar. 31, 2014, the disclosure of which is herein incorporated by reference in its entirety.

BACKGROUND

Technical Field

The present invention relates to an image recording apparatus configured to convey a sheet along a conveyance path and record an image on the sheet.

Description of the Related Art

There is known an image recording apparatus including a housing in which a conveyance path is defined, and an image is recorded on a sheet conveyed along the conveyance path. To perform maintenance and clear paper jam in the conveyance path, for example, the housing has an opening through which the conveyance path is accessible by a user. The opening can be opened and closed by a cover. Also, there is known a construction in which a nip of a conveying roller pair is released in conjunction with opening of the cover.

SUMMARY

A position of the nip of the conveying roller pair is preferably positioned accurately because the position affects a sheet conveying direction and a conveying distance. In the above-described construction in which the nip of the conveying roller pair is released in conjunction with opening of the cover, however, the position of the nip of the conveying roller pair at completion of closing of the cover is unstable, and thereby the sheet conveying direction and the conveying distance are also unstable.

Accordingly, an aspect of the disclosure relates to an image recording apparatus in which a first roller and a second roller are separated from each other in conjunction with opening of a guide member, and the second roller is accurately positioned with respect to the first roller when the guide member is closed.

In one aspect of the disclosure, an image recording apparatus includes: a housing including a frame and formed with a conveyance path; a recording device configured to record an image on a sheet conveyed along the conveyance path in a conveying direction; a first roller disposed on the conveyance path at a position located upstream of the recording device in the conveying direction; a second roller which is opposed to the first roller; a guide member pivotable between (i) a first position at which the guide member defines a portion of the conveyance path and (ii) a second position at which the conveyance path is open; a roller holder coupled to the guide member and supporting the second roller; an urging portion configured to urge the second roller in a direction directed from the second roller toward the first roller; and an engaging portion supported by the roller holder and configured to, when the guide member is located at the first position, be engaged with the frame to position the roller holder to a third position at which the second roller is held in contact with the first roller by an urging force of the urging portion.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is viewed from the front side.

Overall Configuration of MFP 10

Figure 1:
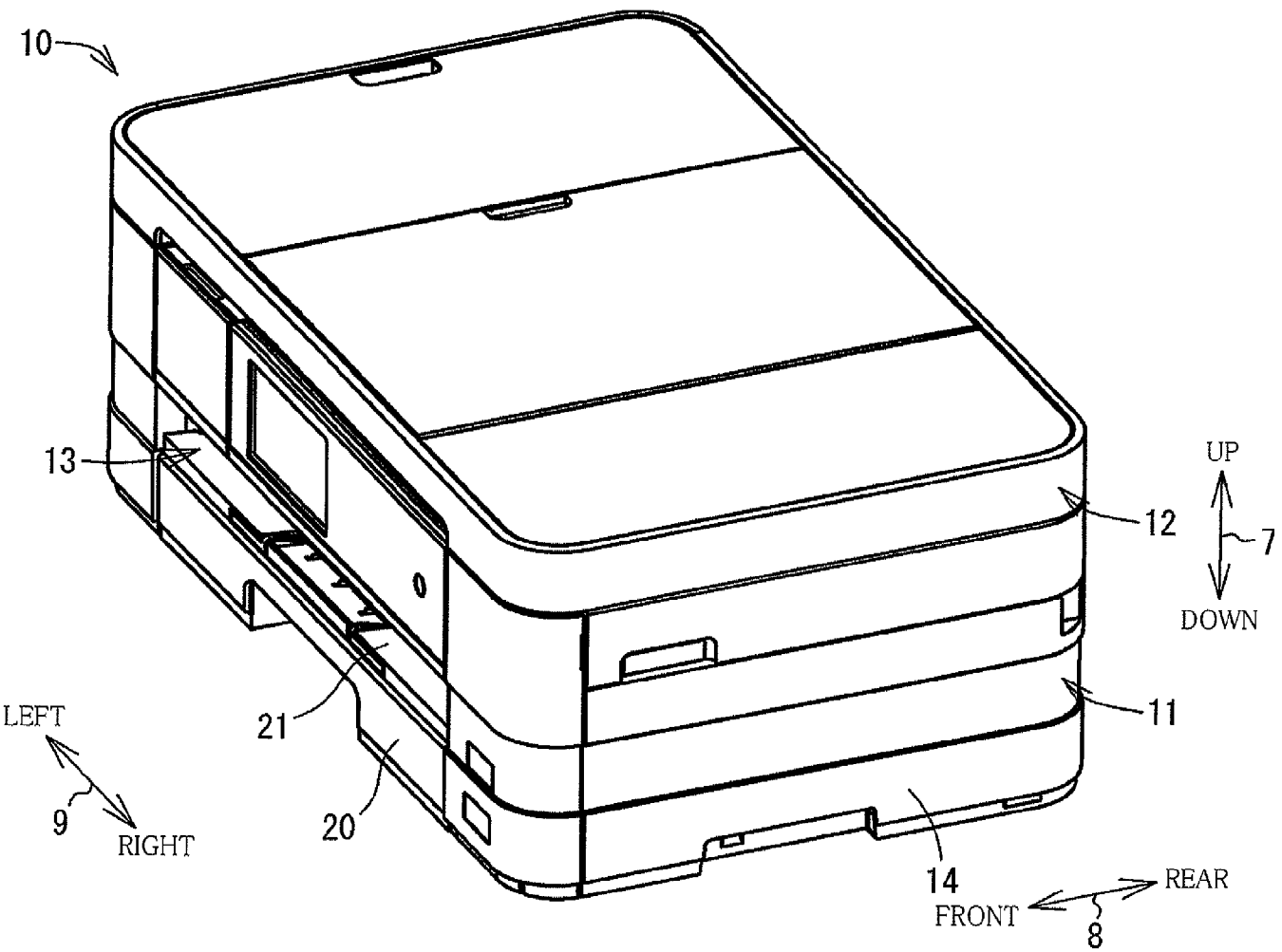
FIG. 1 is a perspective view illustrating a multi-function peripheral (MFP) according to one embodiment.

As illustrated in FIG. 1, the MFP 10 includes a housing 14 having a generally rectangular parallelepiped shape. The MFP 10 has various functions such as a facsimile function and a printing function.

A scanning unit 12 is provided in an upper portion of the housing 14. The scanning unit 12 is constituted as what is called a flatbed scanner, and a detailed explanation of an internal structure of the scanning unit 12 is omitted.

A printing unit 11 (as one example of an image recording apparatus) is provided in a lower portion of the housing 14. The printing unit 11 has an ink jet printing function for recording an image on a recording sheet. Devices and components provided in the housing 14 include a base frame 83, a pair of side frames 55, guide rails 56, 57, a supply tray 20, a supply device 16, a conveyance path 65, a recording device 24, roller pairs 59, 44, guide members 18, 19, 31, a roller holder 85, and contact members 41.

Frame

Figure 7:
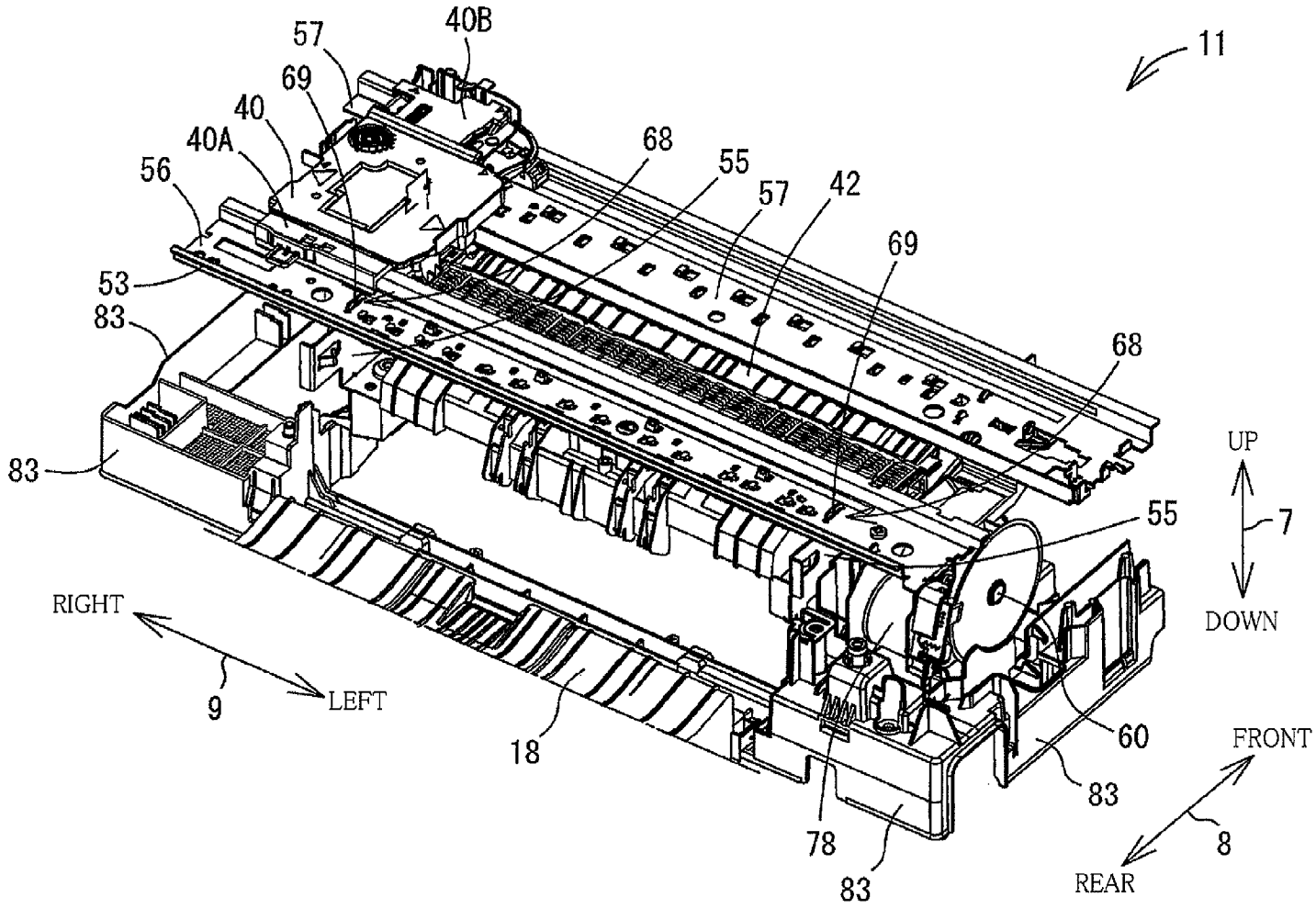
FIG. 7 is a perspective view illustrating a rear portion of the printing unit.

As illustrated in FIG. 7, the housing 14 contains at least three types of frames, namely, the base frame 83, the pair of side frames 55, and the guide rails 56, 57.

The base frame 83 is a resin frame forming a skeletal portion of a lower portion of the printing unit 11. The pair of side frames 55 (each one example of the coupled frame) are spaced apart from each other in the right and left direction 9. Each of the side frames 55 is a metal frame. The side frames 55 are respectively disposed on right and left sides of the conveyance path 65. The side frames 55 are supported by the base frame 83. The side frames 55 are secured to the base frame 83 by, e.g., screws.

The guide rails 56, 57 are spaced apart from each other in the front and rear direction 8. The guide rail 56 is one example of a frame. Each of the guide rails 56, 57 is a metal frame. Each of the guide rails 56, 57 is supported by the pair of side frames 55 and generally fixed to the base frame 83. Protruding portions 69 formed on the side frames 55 are respectively fitted in openings 68 formed in the guide rails 56, 57. As a result, each of the side frames 55 is coupled to the guide rails 56, 57. It is noted that the side frames 55 and the guide rails 56, 57 may be coupled to each other by methods other than the above-described one, for example, the side frames 55 and the guide rails 56, 57 may be coupled to each other by screws. The guide rails 56, 57 will be explained later in more detail.

Supply Tray 20

As illustrated in FIG. 1, the opening 13 is formed in a front portion of the printing unit 11. The supply tray 20 can be inserted and removed into and from the printing unit 11 in the front and rear direction 8 through the opening 13. The supply tray 20 is disposed in the lower portion (i.e., a bottom portion) of the housing 14 in the state in which the supply tray 20 is mounted in the printing unit 11. The supply tray 20 is shaped like a box opening upward. A multiplicity of recording sheets can be stacked on a bottom plate 22 of the supply tray 20 (see FIG. 2).

An output tray 21 is provided over the supply tray 20. The output tray 21 is moved in the front and rear direction 8 together with the supply tray 20. The recording sheet printed by the recording device 24 is discharged onto an upper surface of the output tray 21.

Supply Device 16

Figure 2:
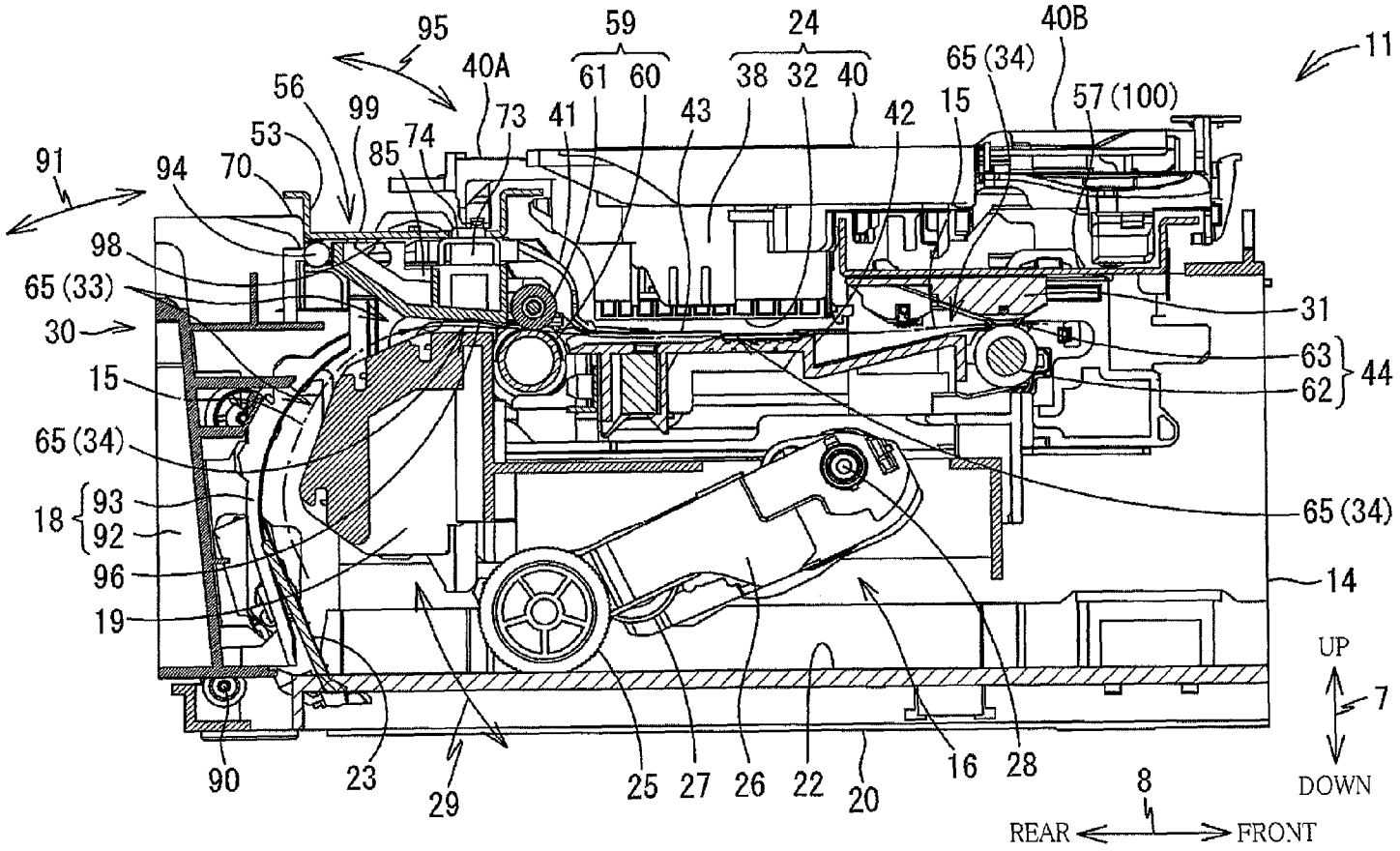
FIG. 2 is an elevational view in vertical cross section illustrating an internal structure of a printing unit, with an outer guide member located at a first position and a roller holder located at a third position.

As illustrated in FIG. 2, the supply device 16 is provided under the recording device 24 and over the supply tray 20 fitted in the printing unit 11. The supply device 16 includes a supply roller 25, a supply arm 26, and a driving-force transmission mechanism 27. The supply roller 25 is supported by a shaft provided at a distal end portion of the supply arm 26. The supply arm 26 is pivoted about a support shaft 28 provided on a basal end portion thereof in a direction indicated by the arrow 29. This construction allows the supply roller 25 to be moved toward and away from the supply tray 20 or a recording sheet supported by the supply tray 20.

The supply roller 25 is rotated by a driving force which is generated by a motor 78 (see FIG. 7) and transmitted by the driving-force transmission mechanism 27 including a plurality of gears meshed with each other. As a result, an uppermost one of the recording sheets supported on the bottom plate 22 is supplied along the conveyance path 65.

It is noted that power may be transmitted to the supply roller 25 from a motor different from the motor 78. The constituent element of the driving-force transmission mechanism 27 is not limited to the plurality of gears and may be a belt looped over the support shaft 28 and a shaft of the supply roller 25, for example.

Conveyance Path 65

As illustrated in FIG. 2, the conveyance path 65 extends from a rear edge portion of the supply tray 20. The conveyance path 65 includes a curved portion 33 and an extending portion 34. The curved portion 33 is curved upward and frontward from the rear edge portion of the supply tray 20. The extending portion 34 is continuous to an upper end of the curved portion 33 and extends in the front and rear direction 8.

The curved portion 33 is defined by the outer guide member 18 (as one example of a guide member), the roller holder 85, an inclined plate 23, and an inner guide member 19. The outer guide member 18, the roller holder 85, and the inclined plate 23 are opposed to and spaced apart from the inner guide member 19. The extending portion 34 is defined by the roller holder 85, the recording device 24, an upper guide member 31, the inner guide member 19, and a platen 42. In other words, the roller holder 85 defines at least a portion of the curved portion 33 and the extending portion 34. It is noted that the roller holder 85 may define at least a portion of only one of the curved portion 33 and the extending portion 34.

The recording sheet supported by the supply tray 20 is supplied by the supply roller 25 to the inclined plate 23 provided on the supply tray 20. The inclined plate 23 changes a direction of travel of the recording sheet to supply the recording sheet into the curved portion 33. The recording sheet supplied into the curved portion is conveyed from a lower end to an upper end of the curved portion 33 and then to the conveying roller pair 59. The recording sheet nipped by the conveying roller pair 59 is conveyed in the front and rear direction 8 through the extending portion 34 toward the recording device 24. Under the recording device 24, the recording device 24 records an image on the conveyed recording sheet. The recording sheet on which the image has been recorded is conveyed further in the front and rear direction 8 through the extending portion 34 and discharged onto the output tray 21. In view of the above, the recording sheet is conveyed in a conveying direction 15 indicated by the one-dot chain line arrow in FIG. 2.

Recording Device 24

As illustrated in FIG. 2, the recording device 24 is provided on an upper side of the extending portion 34. The platen 42 is provided under the recording device 24 so as to be opposed to the recording device 24. The platen 42 is provided with a plurality of ribs 43 standing upright on an upper surface of the platen 42 and extending in the front and rear direction 8. The ribs 43 are spaced apart from each other in the right and left direction 9. The ribs 43 support the recording sheet conveyed through the extending portion 34 of the conveyance path 65.

The recording device 24 includes a carriage 40 and a recording head 38. The carriage 40 is supported by the guide rails 56, 57 so as to be reciprocable in the right and left direction 9. A rear end portion 40A of the carriage 40 is held in contact with an upper surface 99 (as one example of a first contact surface) of the guide rail 56. A front end portion 40B of the carriage 40 is held in contact with an upper surface 100 of the guide rail 57.

The recording head 38 is mounted on the carriage 40. Ink is supplied from an ink cartridge, not shown, to the recording head 38. A lower surface 32 of the recording head 38 has a multiplicity of nozzles, not shown. During movement of the carriage 40 in the right and left direction 9, the recording head 38 ejects ink droplets from the nozzles toward the platen 42. As a result, an image is formed on the recording sheet conveyed along the extending portion 34 and supported on the platen 42.

Contact members 41

Figure 3:
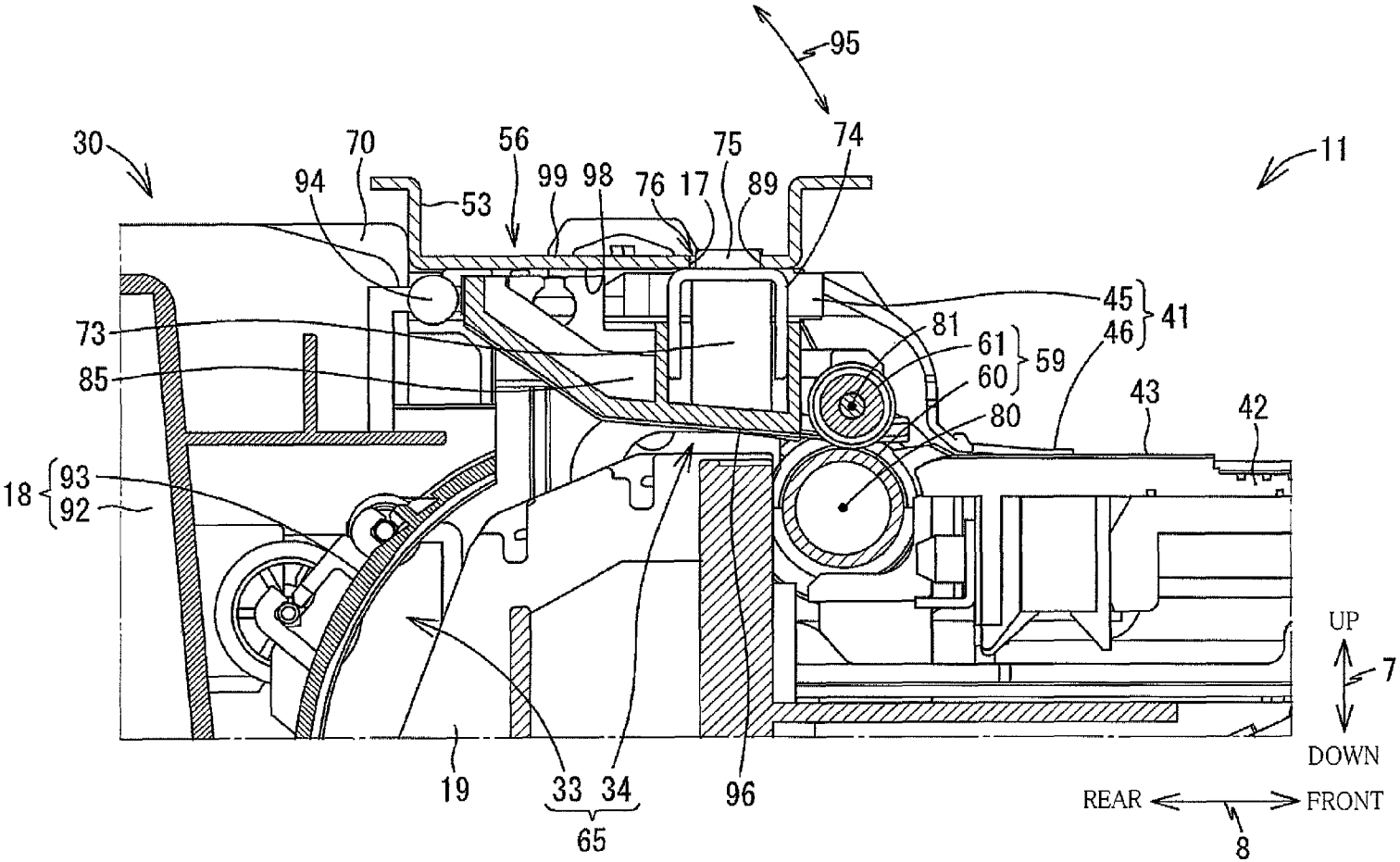
FIG. 3 is an enlarged view illustrating components around the roller holder in FIG. 2.

As illustrated in FIGS. 2 and 3, the contact members 41 are disposed on the conveyance path 65 on an upstream side of the recording device 24 in the conveying direction 15. The contact members 41 are spaced apart from each other in the right and left direction 9. Each of the contact members 41 is disposed between corresponding adjacent two of the ribs 43. Basal end portions 45 of the respective contact members 41 are located at a rear of the conveying roller pair 59 and supported by the roller holder 85. The contact members 41 extend while being curved downward and frontward from the respective basal end portions 45.

Each of the contact members 41 extends in the conveying direction 15 to a position located between the nozzles and the conveying roller pair 59. Distal end portions 46 of the respective contact members 41 are located below upper ends of the respective ribs 43. The distal end portions 46 contact an upper surface of the recording sheet being conveyed along the extending portion 34. The upper surface of the recording sheet is pressed by the distal end portions 46, and a lower surface of the recording sheet is pressed by the ribs 43, so that the shape of the recording sheet is changed to a shape of waves continuous in the right and left direction 9.

Conveying Roller Pair 59 and Output Roller Pair 44

As illustrated in FIGS. 2 and 3, the conveying roller pair 59 is disposed on the extending portion 34 at a position located upstream of the recording device 24 in the conveying direction 15. The output roller pair 44 is disposed on the extending portion 34 at a position located downstream of the recording device 24 in the conveying direction 15.

The conveying roller pair 59 includes: a conveying roller 60 (as one example of a first roller) disposed on a lower side of the extending portion 34; and pinch rollers 61 (each as one example of a second roller) disposed on an upper side of the extending portion 34 and opposed to the conveying roller 60. The conveying roller 60 is rotated, with the right and left direction 9 being as its axial direction. The pinch rollers 61 are spaced apart from each other in the right and left direction 9. Each of the pinch rollers 61 is rotated, with the right and left direction 9 being as its axial direction. Each of the pinch rollers 61 is pressed onto the conveying roller 60 respectively by coil springs 73.

The conveying roller 60 is rotatably supported by the pair of side frames 55 (see FIG. 7). The pinch rollers 61 are rotatably supported by the roller holder 85.

The output roller pair 44 includes: an output roller 62 disposed on a lower side of the extending portion 34; and spur rollers 63 disposed on an upper side of the extending portion 34 and opposed to the output roller 62. Each of the output roller 62 and the spur rollers 63 is rotated, with the right and left direction 9 being as their axial direction. The spur rollers 63 are pressed onto the output roller 62 respectively by resilient members, not shown. The output roller 62 is rotatably supported by the pair of side frames 55 (see FIG. 7). The spur rollers 63 are rotatably supported by the upper guide member 31.

The conveying roller 60 and the output roller 62 are rotated by a driving force generated by the motor 78 (see FIG. 7). When the conveying roller 60 is rotated in a state in which the recording sheet is nipped by the conveying roller pair 59, the recording sheet is conveyed by the conveying roller pair 59 in the conveying direction 15 toward the platen 42. When the output roller 62 is rotated in a state in which the recording sheet is nipped by the output roller pair 44, the recording sheet is conveyed by the output roller pair 44 in the conveying direction 15 toward the output tray 21. It is noted that power may be transmitted to the conveying roller 60 and the output roller 62 from a motor different from the motor 78.

Guide Rails 56, 57

Each of the guide rails 56, 57 illustrated in FIG. 2 is generally shaped like a plate extending in the front and rear direction 8 and in the right and left direction 9. As illustrated in FIGS. 2, 3, and 7, a rear end portion of the guide rail 56 is bent upward so as to form a rear bent portion 53. As illustrated in FIG. 2, the guide rail 57 is located in front of the guide rail 56. Front and rear end portions of the carriage 40 are respectively supported by the guide rails 56, 57.

A well-known belt mechanism, not shown, is disposed on an upper surface of the guide rail 57. The belt mechanism includes: pulleys respectively disposed on right and left end portions of the guide rail 57; and a belt looped over the pulleys. The belt is coupled to the carriage 40 and a carriage driving motor, not shown, for applying a driving force to the carriage 40. Upon driving of the carriage driving motor, the driving force is transmitted to the carriage 40 via the belt mechanism such that the carriage 40 is moved in the right and left direction 9. As a result, the carriage 40 is reciprocated in the right and left direction 9.

Guide Member 30

As illustrated in FIG. 2, a guide member 30 is disposed upstream of the recording device 24 in the conveying direction 15. The guide member 30 includes an outer guide member 18 and the roller holder 85. The outer guide member 18 is supported by the base frame 83 (see FIG. 7) so as to be pivotable, in a direction indicated by an arrow 91, about a shaft 90 which is provided upstream of the outer guide member 18 in the conveying direction 15 and extends in the right and left direction 9. With this construction, the guide member 30 is pivoted about an axis located at its upstream end portion in the conveying direction 15, such that a downstream end portion of the guide member 30 in the conveying direction 15 serves as a distal end during pivotal movement (noted that this distal end may be hereinafter referred to as "pivotal-movement distal end").

The outer guide member 18 is provided nearer to the shaft 90 than the roller holder 85, that is, the outer guide member 18 is provided upstream of the roller holder 85 in the conveying direction 15. The roller holder 85 is provided nearer to the pivotal-movement distal end of the guide member 30 than the outer guide member 18, that is, the roller holder 85 is provided downstream of the outer guide member 18 in the conveying direction 15.

An outer side (edge) of the curved portion 33 is defined by the outer guide member 18, the roller holder 85, and the inclined plate 23. It is noted that the outer side of the curved portion 33 may be defined only by the outer guide member 18 and the roller holder 85. In view of the above, the guide member 30 defines at least a portion of the outer side of the curved portion 33.

Outer Guide Member 18

As illustrated in FIG. 2, the outer guide member 18 can be pivoted or swung about the shaft 90 in the direction indicated by the arrow 91. In the lower or bottom portion of the housing 14, the shaft 90 protrudes outward from opposite ends of the outer guide member 18 in the right and left direction 9. The shaft 90 is supported by bearings, not shown, of the housing 14, so that the outer guide member 18 is pivotably supported by the housing 14. It is noted that FIG. 7 omits illustration of a portion of the outer guide member 18 near the pivotal-movement distal end.

The outer guide member 18 includes: a side wall 92 partly constituting a rear surface of the housing 14; and a guide portion 93 disposed in front of the side wall 92 and supported by the side wall 92. The guide portion 93 is shaped like a plate curved at a portion thereof near the curved portion 33.

Figure 6:
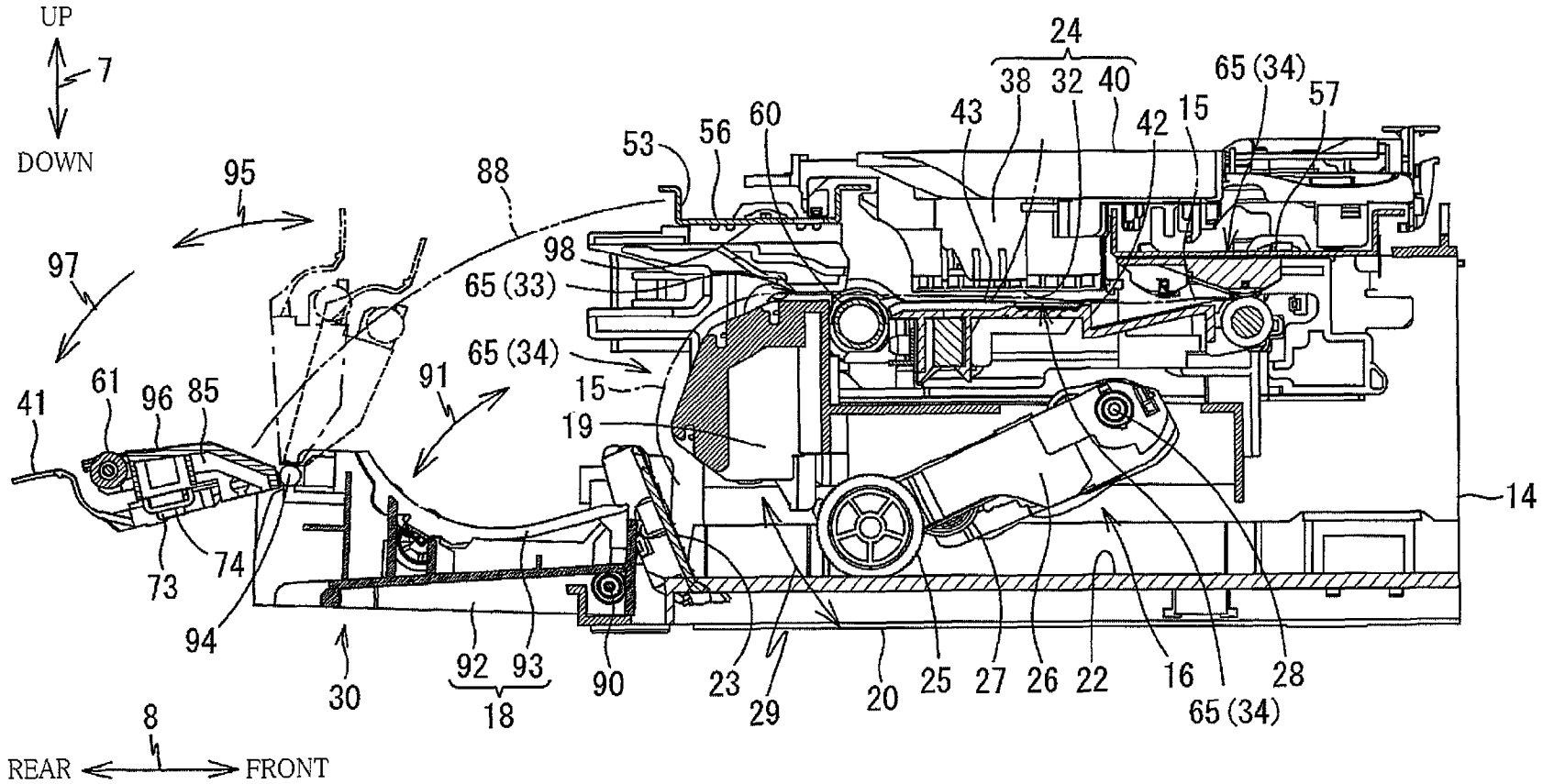
FIG. 6 is an elevational view in vertical cross section illustrating the internal structure of the printing unit, with the outer guide member located at the second position and the roller holder located at a fourth position.

The outer guide member 18 is pivoted between the first position illustrated in FIG. 2 and the second position illustrated in FIG. 6. When the outer guide member 18 is located at the first position, the guide portion 93 defines the outer side of the curved portion 33. When the outer guide member 18 is located at the second position, the curved portion 33 is exposed to an outside. A user of the MFP 10 can pivot the outer guide member 18 from the first position to the second position to remove a recording sheet jammed in the curved portion 33.

Projecting portions 70 are formed on a pivotal-movement distal end portion of the outer guide member 18. The projecting portions 70 are respectively formed on left and right end portions of the outer guide member 18. When the outer guide member 18 is located at the first position, the projecting portions 70 project frontward. In this state, the projecting portions 70 are held in contact with the rear bent portion 53 of the guide rail 56. This contact positions the outer guide member 18 to the first position in the front and rear direction 8.

Roller Holder 85

As illustrated in FIGS. 2 and 3, the roller holder 85 is disposed under the guide rail 56. The roller holder 85 is elongated in the right and left direction 9. A front portion of the roller holder 85 supports the pinch rollers 61 such that the pinch rollers 61 are rotatable.

A rear end portion of the roller holder 85 is provided with a shaft 94 extending in the right and left direction 9. The shaft 94 is supported by the outer guide member 18, coupling the roller holder 85 to the outer guide member 18. The roller holder 85 is pivotable integrally with the outer guide member 18, with respect to the housing 14, in the direction indicated by the arrow 91. Also, as illustrated in FIG. 6, the roller holder 85 is pivotable about the shaft 94 with respect to the outer guide member 18 in a direction indicated by an arrow 95. It is noted that when a front end of the roller holder 85 is located in front of a rear end of the guide rail 56 (for example, when the outer guide member 18 is located at the first position), pivotal movement of the roller holder 85 is limited by the guide rail 56.

The roller holder 85 is pivotable between a third position illustrated in FIG. 2 and a fourth position indicated by the solid lines in FIG. 6.

As illustrated in FIGS. 2 and 3, when the outer guide member 18 is located at the first position, the roller holder 85 is located at the third position. When the roller holder 85 is located at the third position, a rear portion of a lower surface 96 of the roller holder 85 defines the outer side of the curved portion 33, and a front portion of the lower surface 96 of the roller holder 85 defines an upper side of the extending portion 34. When the roller holder 85 is located at the third position, the pinch rollers 61 face the conveying roller 60 and are held in contact with the conveying roller 60 from an upper side thereof.

In the state in which the pinch rollers 61 and the conveying roller 60 are held in contact with each other, an axis 81 (see FIG. 3) of the pinch rollers 61 (which is a line extending in the right and left direction 9 so as to pass through centers of the respective pinch rollers 61 is located in front of an axis 80 (see FIG. 3) of the conveying roller 60 (which is a line extending in the right and left direction 9 so as to pass through a center of the conveying roller 60). Consequently, the recording sheet nipped by the conveying roller pair 59 is conveyed obliquely downward in the front direction and pressed onto the platen 42. This construction can fix a distance between the recording head 38 and the recording sheet supported by the platen 42.

As illustrated in FIG. 6, when the outer guide member 18 is located at the second position, the roller holder 85 is pivotable between a fifth position indicated by the broken lines and the fourth position indicated by the solid lines. A position of the roller holder 85 located at the fifth position relative to the outer guide member 18 is located slightly in front of a position of the roller holder 85 located at the third position relative to the outer guide member 18 (i.e., the position indicated by the one-dot chain lines in FIG. 6). It is noted that pivotal movement of the roller holder 85 to a front side of the fifth position is limited by a stopper, not shown, provided on the outer guide member 18. The roller holder 85 is pivoted from the third position or the fifth position in a direction indicated by an arrow 97 and positioned at a rear of the outer guide member 18 located at the second position. In this state, the roller holder 85 is located at the fourth position. As illustrated in FIG. 6, the roller holder 85 located at the fourth position extends in a direction directed from an inner side to an outer side of an arc of a pivoting path 88 which is formed when the outer guide member 18 is pivoted in the direction indicated by the arrow 97. It is noted that this arc is centered about the shaft 90.

Coil Springs 73 and Engagement Members 74

As illustrated in FIGS. 2 and 3, pairs of the coil springs 73 and engagement members 74 are provided on the roller holder 85. The pairs of the coil springs 73 and the engagement members 74 are spaced apart from each other in the right and left direction 9. Each of the coil springs 73 is supported by the roller holder 85, and each of the engagement members 74 is supported by the corresponding one of the coil springs 73. The coil springs 73 are interposed between the roller holder 85 and the respective engagement members 74.

Lower end portions of the respective coil springs 73 are held in contact with the roller holder 85, and upper end portions of the respective coil springs 73 are held in contact with the respective engagement members 74. Lower surfaces of the respective engagement members 74 are respectively held in contact with the upper end portions of the respective coil springs 73. Upper surfaces of the respective engagement members 74 are held in contact with a lower surface 98 of the guide rail 56. Projections 75 (each as one example of a first engaging portion) are formed on the upper surfaces of the respective engagement members 74. The guide rail 56 has openings 76 (each as one example of a second engaging portion) at positions corresponding to the respective engagement members 74. The openings 76 may not extend through the guide rail 56 in the up and down direction 7. For example, each of the openings 76 may be a recessed portion which is recessed in a direction directed from the lower surface 98 to the upper surface 99. It is noted that the following explanation is provided for one of the coil springs 73 and one of the contact members 41 for simplicity unless otherwise required by context.

The engagement member 74 is movably supported by the roller holder 85 via the coil spring 73. Specifically, extension and compression of the coil spring 73 can move the engagement member 74 selectively to one of an engaged position illustrated in FIG. 2 and a separated position illustrated in FIG. 4 which is located below the engaged position.

When the outer guide member 18 is located at the first position, and the roller holder 85 is located at the third position, the projection 75 is urged upward by the coil spring 73 and fitted in the opening 76, whereby the engagement member 74 is moved to the engaged position. As a result, the engagement member 74 and the guide rail 56 are engaged with each other. In other words, when the outer guide member 18 is located at the first position, and the roller holder 85 is located at the third position, the engagement member 74 is disposed between the coil spring 73 and the guide rail 56. In this state, the coil spring 73 is compressed and has a length shorter than its natural length. As a result, the coil spring 73 urges the pinch roller 61 toward the conveying roller 60, i.e., in a direction directed from the pinch roller 61 to the conveying roller 60 and urges the engagement member 74 in a direction directed from the engagement member 74 toward the opening 76 of the guide rail 56. As a result, the pinch roller 61 is pressed on the conveying roller 60, and the projection 75 is kept inserted in the opening 76. As will be described below, when the outer guide member 18 is moved in the direction indicated by the arrow 97 from the first position toward the second position, the projection 75 is moved out of the opening 76. As a result, the engagement member 74 is moved to the separated position.

In the present embodiment, the coil spring 73 is used for urging the projection 75 upward and urging the pinch roller 61 toward the conveying roller 60. However, an urging member for urging the projection 75 upward and an urging member for urging the pinch roller 61 toward the conveying roller 60 may be independent of each other.

Pivotal Movement of Guide Member 30

There will be next explained pivotal movement of the guide member 30. As illustrated in FIGS. 2 and 3, when the outer guide member 18 is located at the first position, the roller holder 85 is located at the third position.

When the outer guide member 18 is located at the first position, the projecting portions 70 are held in contact with the rear bent portion 53 of the guide rail 56.

When the roller holder 85 is located at the third position, the engagement member 74 is inserted in the opening 76 of the guide rail 56 and located at the engaged position. As a result, the roller holder 85 is positioned to the third position. It is noted that, as illustrated in FIG. 3, the engagement member 74 inserted in the opening 76 is held in contact with a front surface 89 of the opening 76.

When the roller holder 85 is located at the third position, the distal end portion 46 of the contact member 41 is located below a position at which the conveying roller pair 59 nips the recording sheet. When the roller holder 85 is located at the third position, the pinch roller 61 is held in contact with the conveying roller 60 by an urging force of the coil spring 73.

When the outer guide member 18 is pivoted from the first position to the second position in the direction indicated by the arrow 91, the roller holder 85 is pivoted rearward integrally and together with the outer guide member 18. Consequently, the projection 75 of the engagement member 74 is held in pressing contact with a rear side surface 17 of the opening 76. As a result, the projection 75 receives a force of reaction from the rear side surface 17. The force of the reaction compresses the coil spring 73, which moves the engagement member 74 downward. As a result, as illustrated in FIG. 4, the projection 75 comes out of the opening 76, which releases the engagement of the engagement member 74 and the guide rail 56.

When the outer guide member 18 is pivoted further toward the second position, the projection 75 is moved rearward along the lower surface 98 (as one example of a second contact surface) of the guide rail 56 by the urging force of the coil spring 73 in a state in which the projection 75 is held in contact with the lower surface 98. In this state, the engagement member 74 is located at the separated position located below the engaged position. When the projection 75 is moved to a position located at a rear of the lower surface 98, the compressed coil spring 73 returns to its natural length.

Figure 4:
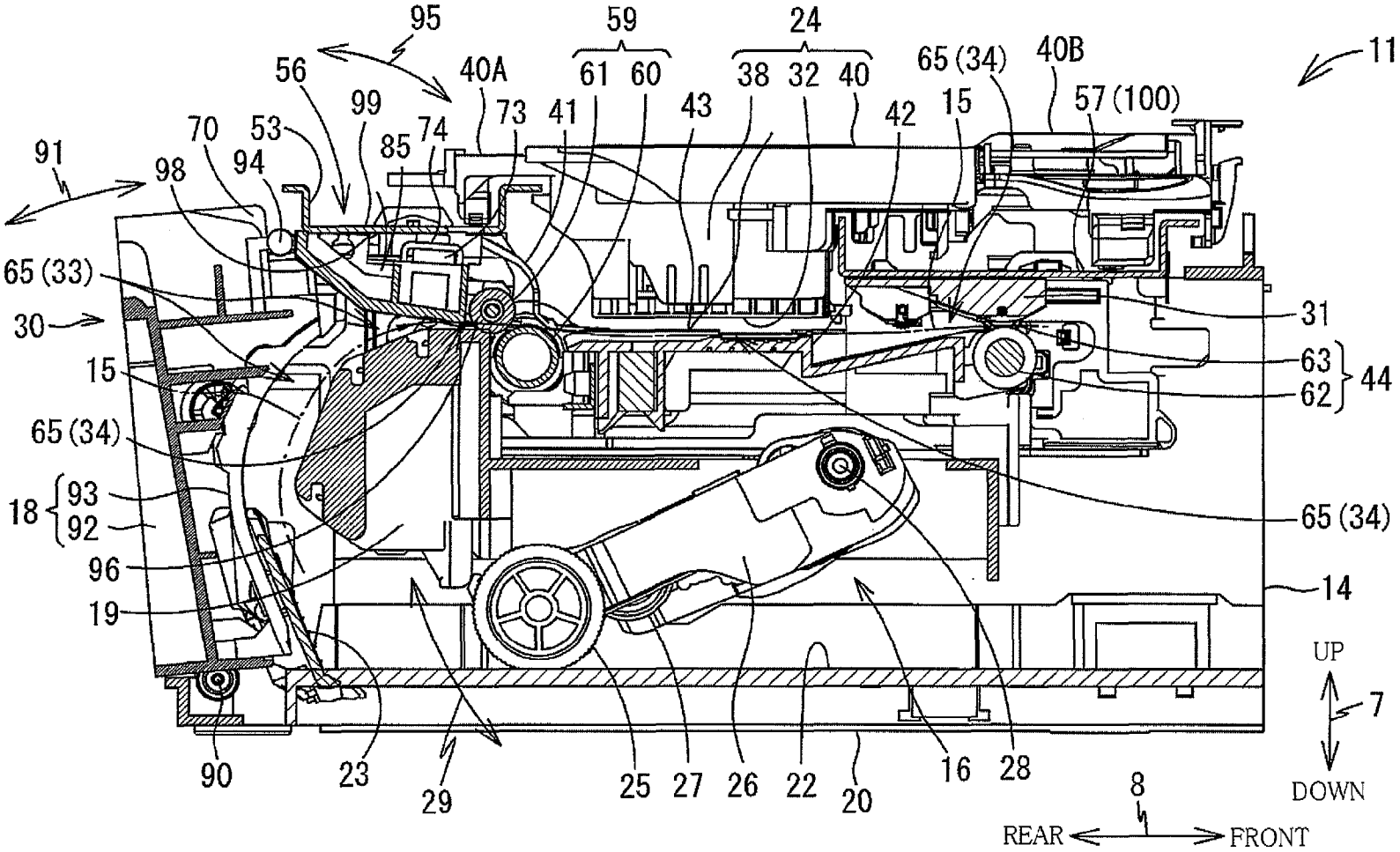
FIG. 4 is an elevational view in vertical cross section illustrating the internal structure of the printing unit when the outer guide member is located nearer to a second position than the position of the outer guide member illustrated in FIG. 2.

In the state illustrated in FIG. 4, the lower surface 96 of the roller holder 85 is supported by the inner guide member 19. The roller holder 85 is guided rearward along a surface of the extending portion 34 which is nearer to the inner guide member 19. The contact member 41 and the pinch roller 61 are also guided rearward integrally with the roller holder 85. As a result, the pinch roller 61 is moved off the conveying roller 60.

Figure 5:
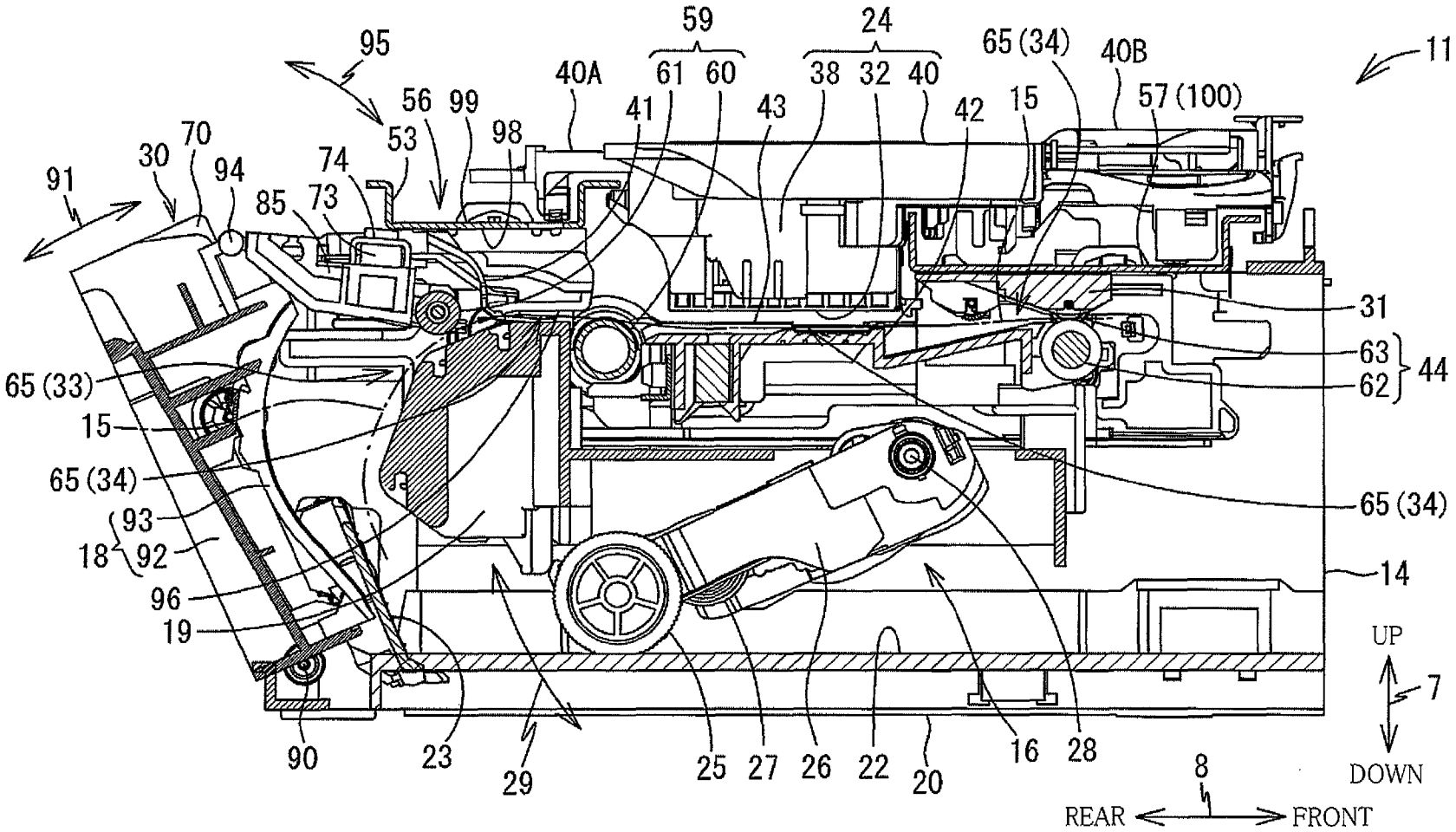
FIG. 5 is an elevational view in vertical cross section illustrating the internal structure of the printing unit when the outer guide member is located nearer to a second position than the position of the outer guide member illustrated in FIG. 4.

The lower surface 96 of the roller holder 85 guided rearward is moved off the surface of the extending portion 34 which is nearer to the inner guide member 19 and supported by a surface of the inner guide member 19 nearer to the curved portion 33. Here, the surface of the inner guide member 19 nearer to the curved portion 33 is curved obliquely downward in the rear direction. Accordingly, the roller holder 85 is pivoted downward by its own weight in accordance with the guided movement of the roller holder 85 rearward. This pivotal movement is limited by the above-described stopper. With this limitation, when the roller holder 85 is moved rearward from a particular position, the roller holder 85 comes off the inner guide member 19 (see FIG. 5).

By being further pivoted toward the second position, the outer guide member 18 reaches the second position (see FIG. 6). In this state, the roller holder 85 is located at the fifth position indicated by the broken lines in FIG. 6, the pinch roller 61 is spaced apart from the conveying roller 60, and the contact member 41 is spaced apart from the conveyance path 65. In this state, the roller holder 85 is pivotable, toward the fourth position indicated by the solid lines in FIG. 6, in the direction indicated by the arrow 97.

When the outer guide member 18 is pivoted to the first position in a state in which the outer guide member 18 is located at the second position, and the roller holder 85 is located at the fourth position (see FIG. 6), the roller holder 85 is first pivoted from the fourth position to the fifth position in a direction reverse to the direction indicated by the arrow 97.

When the outer guide member 18 is then pivoted toward the first position in the direction indicated by the arrow 91, the projection 75 is brought into pressing contact with the rear bent portion 53 of the guide rail 56. Consequently, the projection 75 receives a force of reaction from the rear bent portion 53. This force of the reaction compresses the coil spring 73, thereby moving the engagement member 74 downward, so that the projection 75 is brought into contact with the lower surface 98 of the guide rail 56 (see FIG. 5). As a result, the engagement member 74 is moved into the housing 14 from a position located between the guide rail 56 and the inner guide member 19. In this state, the engagement member 74 is located at the separated position.

When the roller holder 85 is moved to a position in front of the particular position, the lower surface 96 of the roller holder 85 is brought into contact with the inner guide member 19. The roller holder 85 is thereafter guided along the surface of the inner guide member 19 nearer to the conveyance path 65 (see FIG. 4).

When the outer guide member 18 is further pivoted toward the first position in the direction indicated by the arrow 91, as illustrated in FIG. 2, the projecting portions 70 are brought into contact with the rear bent portion 53 of the guide rail 56, and the outer guide member 18 reaches the first position. In this state, the projection 75 is inserted in the opening 76 of the guide rail 56, so that the engagement member 74 is located at the engaged position, and the roller holder 85 is located at the third position. When the roller holder 85 is located at the third position, the pinch roller 61 is held in contact with the conveying roller 60, and the contact member 41 can contact an upper surface of the recording sheet being conveyed in the conveying direction 15.

As illustrated in FIG. 3, when the outer guide member 18 is located at the first position, the axis 81 of the pinch roller 61 is located downstream of the axis 80 of the conveying roller 60 in the conveying direction 15.

Effects

In the present embodiment, when the outer guide member 18 is located at the second position, the conveyance path 65 is opened, and the pinch roller 61 is spaced apart from the conveying roller 60. When the outer guide member 18 is located at the first position, the engagement member 74 is engaged with the guide rail 56, and the roller holder 85 is positioned to the third position. When the roller holder 85 is located at the third position, the pinch roller 61 is urged by the coil spring 73 and held in contact with the conveying roller 60. In view of the above, in the present embodiment, the conveying roller 60 and the pinch roller 61 are spaced apart from each other in conjunction with opening of the outer guide member 18, and the pinch roller 61 is accurately positioned with respect to the conveying roller 60 when the outer guide member 18 is closed.

In the present embodiment, the guide rail 56 supports the recording device 24. Accordingly, the position at which the conveying roller 60 and the pinch roller 61 nip the recording sheet can be accurately positioned with respect to the recording device 24.

In the present embodiment, the conveying roller 60 is supported by the side frames 55. Accordingly, a relative positional relationship between the conveying roller 60 and the pinch roller 61 is made more accurate.

In the present embodiment, the outer guide member 18 is pivotable to the second position. Accordingly, when the roller holder 85 is located at the fourth position, a path through which the user accesses the conveyance path 65 and which is opened by the outer guide member 18 is made wider.

In the present embodiment, the outer guide member 18 is held in contact with the guide rail 56 when located at the first position. Accordingly, the outer guide member 18 is accurately positioned to the first position.

In the present embodiment, when the outer guide member 18 is located at the first position, the axis 81 of the pinch roller 61 is located in front of the axis 80 of the conveying roller 60. This configuration makes it possible to generate an urging force which positions the outer guide member 18 to the first position and positions the roller holder 85 to the third position.

Modifications

While the conveying roller pair 59 is constituted by the conveying roller 60 and the pinch rollers 61 which are located on an upper side of the conveying roller 60 in the above-described embodiment, the conveying roller 60 may be provided on an upper side of the pinch rollers 61. In this case, the engagement member 74 is configured to be engaged with a frame, not shown, provided in the housing 14 which is different from the guide rail 56.

While the roller holder 85 is coupled to the outer guide member 18 in the above-described embodiment, the roller holder 85 may not be coupled to the outer guide member 18. In this case, the roller holder 85 is removably supported at its rear portion by a component (e.g., the guide rail 56) provided in the housing 14 such that the roller holder 85 is pivotable in the direction indicated by the arrow 95.

What is claimed is:

1. An image recording apparatus, comprising:

a housing comprising a frame and formed with a conveyance path;

a recording device configured to record an image on a sheet conveyed along the conveyance path in a conveying direction;

a first roller disposed on the conveyance path at a position located upstream of the recording device in the conveying direction;

a second roller which is opposed to the first roller;

a guide member pivotable between (i) a first position at which the guide member defines a portion of the conveyance path and (ii) a second position at which the conveyance path is open;

a roller holder coupled to the guide member and supporting the second roller;

an urging portion configured to urge the second roller in a direction directed from the second roller toward the first roller; and an engaging portion attached to the roller holder and configured to be engaged with the frame to position the guide member to the first position at which the second roller is held in contact with the first roller by an urging force of the urging portion.

2. The image recording apparatus according to claim 1, wherein the frame is configured to support the recording device.

3. The image recording apparatus according to claim 1, wherein the frame comprises: a first contact surface which contacts the recording device; and a second contact surface which is a back side from the first contact surface and which is contactable with the engaging portion.

4. The image recording apparatus according to claim 1, wherein the first roller is supported by a coupled frame which is coupled to the frame.

5. The image recording apparatus according to claim 1, wherein the guide member is positioned at the first position by contacting the frame.

6. The image recording apparatus according to claim 1, wherein the frame comprises an opening which is engaged with the engaging portion when the guide member is located at the first position.

7. The image recording apparatus according to claim 1, wherein the roller holder is configured to support the engaging portion such that the engaging portion is movable between (i) an engaged position at which the engaging portion is engaged with the frame and (ii) a separated position at which the engaging portion is not engaged with the frame, and wherein the urging portion is located between the roller holder and the engaging portion and configured to urge the engaging portion in a direction directed from the separated position toward the engaged position.

8. The image recording apparatus according to claim 1, wherein the engaging portion comprises: a first surface which contacts the urging portion; and a second surface which is a back side from the first surface and which is contactable with the frame.

9. The image recording apparatus according to claim 8, wherein a first engaging portion is formed on the second surface of the engaging portion, and wherein a second engaging portion which is engageable with the first engaging portion is formed in the frame.

10. The image recording apparatus according to claim 9, wherein when the guide member is located at the first position, the first engaging portion and the second engaging portion are engaged with each other.

11. An image recording apparatus, comprising:

a housing comprising a frame and formed with a conveyance path;

a recording device configured to record an image on a sheet conveyed along the conveyance path in a conveying direction;

a first roller disposed on the conveyance path at a position located upstream of the recording device in the conveying direction;

a second roller which is opposed to the first roller;

a guide member pivotable between (i) a first position at which the guide member defines a portion of the conveyance path and (ii) a second position at which the conveyance path is open;

a roller holder coupled to the guide member and supporting the second roller;

an urging portion configured to urge the second roller in a direction directed from the second roller toward the first roller; and an engaging portion supported by the roller holder and configured to, when the guide member is located at the first position, be engaged with the frame to position the roller holder to a third position at which the second roller is held in contact with the first roller by an urging force of the urging portion, wherein the roller holder is pivotably coupled at a coupled portion thereof to the guide member, and wherein when the guide member is located at the second position, the roller holder extends from the coupled portion in a direction directed from an inner side to an outer side of a pivoting path of the guide member.

12. An image recording apparatus, comprising:

a housing comprising a frame and formed with a conveyance path;

a recording device configured to record an image on a sheet conveyed along the conveyance path in a conveying direction;

a first roller disposed on the conveyance path at a position located upstream of the recording device in the conveying direction;

a second roller which is opposed to the first roller;

a guide member pivotable between (i) a first position at which the guide member defines a portion of the conveyance path and (ii) a second position at which the conveyance path is open;

a roller holder coupled to the guide member and supporting the second roller;

an urging portion configured to urge the second roller in a direction directed from the second roller toward the first roller; and an engaging portion supported by the roller holder and configured to, when the guide member is located at the first position, be engaged with the frame to position the roller holder to a third position at which the second roller is held in contact with the first roller by an urging force of the urging portion, wherein the roller holder is configured to support a plurality of second rollers each as the second roller in a state in which the plurality of second rollers are spaced apart from each other in an axial direction of the first roller.

13. An image recording apparatus, comprising:

a housing comprising a frame and formed with a conveyance path;

a recording device configured to record an image on a sheet conveyed along the conveyance path in a conveying direction;

a first roller disposed on the conveyance path at a position located upstream of the recording device in the conveying direction;

a second roller which is opposed to the first roller;

a guide member pivotable between (i) a first position at which the guide member defines a portion of the conveyance path and (ii) a second position at which the conveyance path is open;

a roller holder coupled to the guide member and supporting the second roller;

an urging portion configured to urge the second roller in a direction directed from the second roller toward the first roller; and an engaging portion supported by the roller holder and configured to, when the guide member is located at the first position, be engaged with the frame to position the roller holder to a third position at which the second roller is held in contact with the first roller by an urging force of the urging portion, wherein when the guide member is located at the first position, an axis of the second roller is located downstream of an axis of the first roller in the conveying direction.

14. An image recording apparatus, comprising:

a housing comprising a frame and formed with a conveyance path;

a recording device configured to record an image on a sheet conveyed along the conveyance path in a conveying direction;

a first roller disposed on the conveyance path at a position located upstream of the recording device in the conveying direction;

a second roller which is opposed to the first roller;

a guide member pivotable between (i) a first position at which the guide member defines a portion of the conveyance path and (ii) a second position at which the conveyance path is open;

a roller holder coupled to the guide member and supporting the second roller;

an urging portion configured to urge the second roller in a direction directed from the second roller toward the first roller; and an engaging portion supported by the roller holder and configured to, when the guide member is located at the first position, be engaged with the frame to position the roller holder to a third position at which the second roller is held in contact with the first roller by an urging force of the urging portion, wherein when the guide member is located at the first position, the engaging portion is disposed between the urging portion and the frame.

15. The image recording apparatus according to claim 14, wherein when the guide member is located at the first position, the urging portion urges the second roller in a direction directed from the second roller toward the first roller and urges the engaging portion in a direction directed from the engaging portion toward the frame.

* * * * *